United States Patent [19]

Sjogren et al.

[11] Patent Number: 4,587,751

[45] Date of Patent: May 13, 1986

[54] WEAR CAP STYLE EXCAVATING TOOTH

[75] Inventors: Kaj Sjogren, Aloha; James Brosh, Beaverton, both of Oreg.

[73] Assignee: ESCO Corporation, Portland, Oreg.

[21] Appl. No.: 708,648

[22] Filed: Mar. 6, 1985

[51] Int. Cl.[4] ..... E02F 9/28

[52] U.S. Cl. ..... 37/142 R; 172/753

[58] Field of Search ..... 37/141 R, 141 T, 142 R, 37/142 A; 172/753

[56] References Cited

U.S. PATENT DOCUMENTS 3,839,806 10/1974 Hood et al. ..... 37/142 R 3,851,413 12/1974 Lukavich ..... 37/142 R X 4,192,089 3/1980 Schwappach ..... 37/142 A 4,326,348 4/1982 Emrich ..... 37/142 R 4,428,131 1/1984 Hahn ..... 37/142 R

*Primary Examiner*—Edgar S. Burr

*Assistant Examiner*—Moshe I. Cohen

*Attorney, Agent, or Firm*—Tilton, Fallon, Lungmus & Chestnut

[57] ABSTRACT

An excavating tooth assembly including a relatively elongated adapter equipped with a point at the digging end and at least one wear cap normally held in place by the point, and lock means in the adapter to prevent dislodging of the wear cap.

2 Claims, 7 Drawing Figures

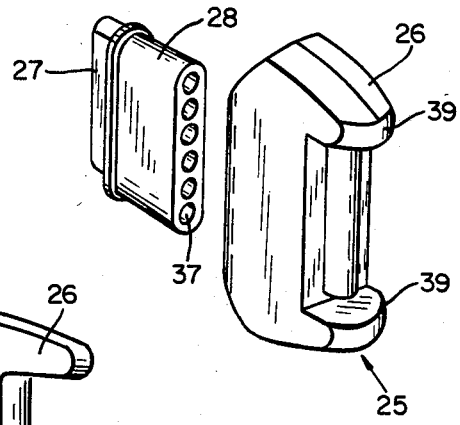
FIG. 3
FIG. 4
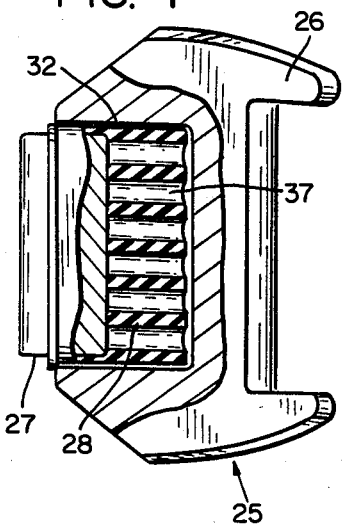
FIG. 1
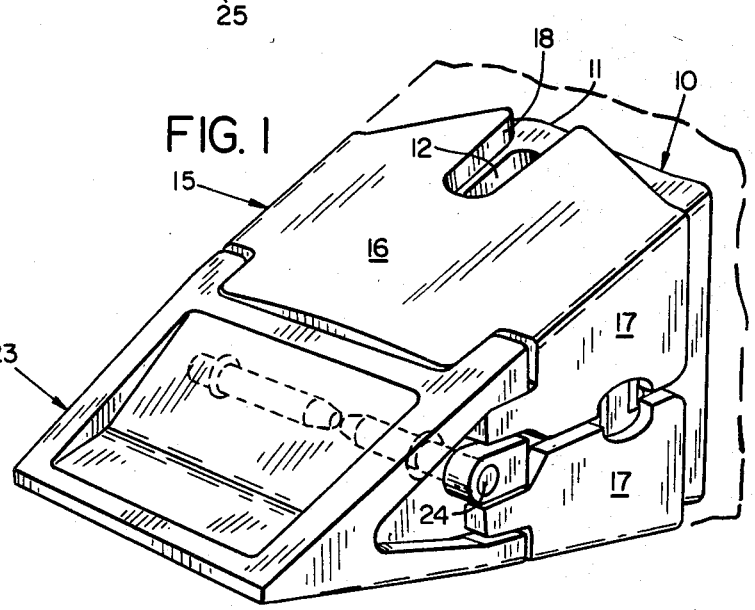
FIG. 2
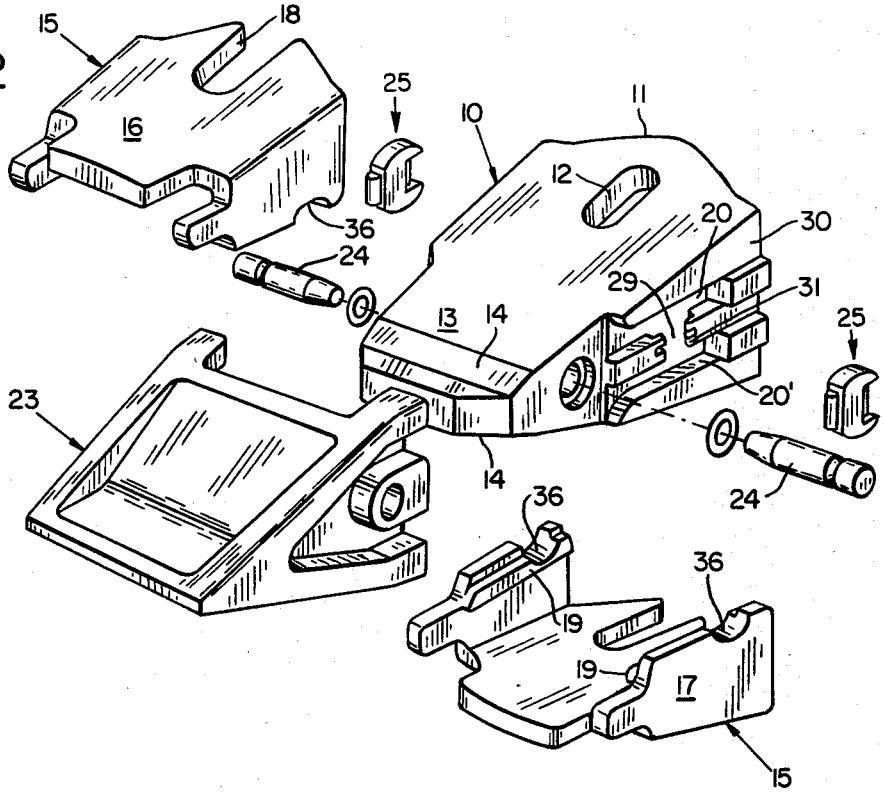

WEAR CAP STYLE EXCAVATING TOOTH

BACKGROUND AND SUMMARY OF INVENTION

This invention relates to a wear cap style excavating tooth and, more particularly, to a tooth assembly wherein the adapter is equipped with special lock means to prevent wear cap loss.

A successful wear cap style excavating tooth is seen in co-owned U.S. Pat. No. 4,326,348. There, the adapter is equipped with top and/or bottom wear caps which are normally held in place by the point, viz., the earth-engaging element of the assembly. However, from time to time, points break or otherwise become dislodged from their mounting on the adapter—in which case there is nothing present in the assembly to prevent loss of one or both of the wear caps, depending upon whether one or two are used.

A simple solution would be to weld the wear caps in place but this defeats the goal of workers in the excavating art which is to have the wearable elements readily replaced. Over the years, many designs have been advanced to retain the point in place under shock loadings but still render the point easily removable when replacement is indicated. Depending upon the digging conditions, from 5 to 20 points normally are installed during the life of the adapter.

Although the wear cap does not take quite the punishment of a point, it is still subjected to serious abrasion as well as shock loads and the goal of having a replaceable wear cap—several during the life of an adapter—would be frustrated by welding.

On the other hand the integrity of the adapter must be maintained because it is the principal element for transmitting loads from the point to the excavator, viz., bucket, dipper, dredge, etc. So, removal of material from the adapter to provide a typical pin lock is not desirable.

The invention has overcome these interrelated problems by providing a lock means in one or both of the side walls of the adapter which normally is unstressed except when the principal restraint against loss of the wear cap is removed as by breakage of a point.

More particularly, the adapter side wall in a position generally intermediate the length of the wear cap is equipped with a cavity into which a lock is resiliently, removably mounted. The wear cap is equipped with a notch means in alignment with the cavity, and hence the lock means, to achieve the objective of the invention.

Other objects and advantages of the invention may be seen in the details of the ensuing specification.

The invention is described in conjunction with an illustrative embodiment in the accompanying drawing, in which FIG. 1 is a perspective view of a tooth embodying teachings of the invention;

FIG. 2 is an exploded perspective view of the tooth of FIG. 1;

FIG. 3 is an exploded perspective view of the lock means of the invention;

FIG. 4 is a side elevational view, partially in section of the lock means of FIG. 3;

Figure 5:
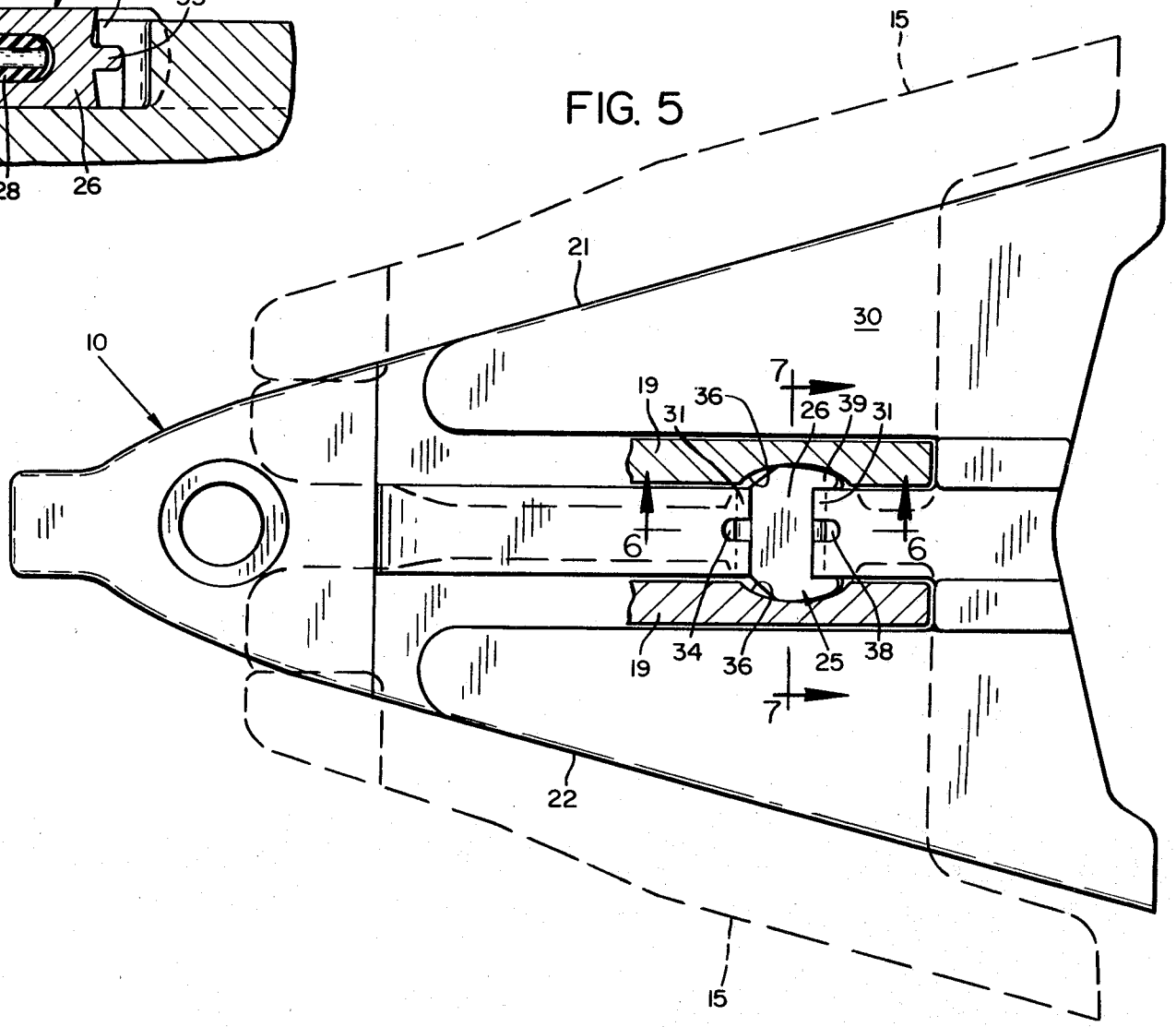
Figure 6:
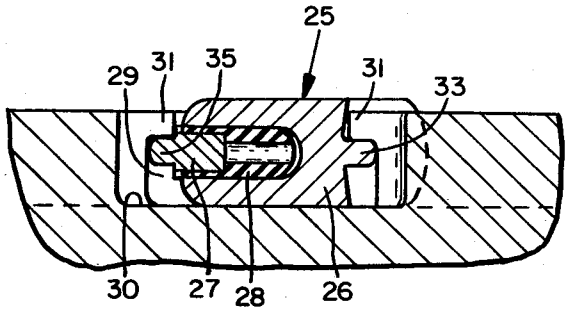
Figure 7:
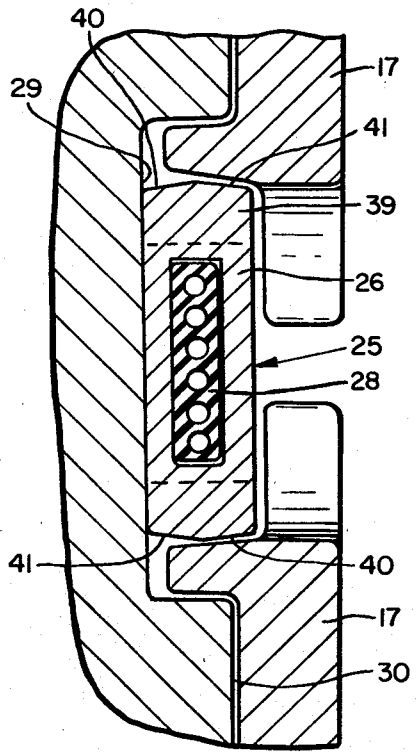

FIG. 5 is a side elevational view, partially in section and partially in phantom of the assembled wear caps and adapter held in place by the lock means according to the teachings of this invention; and FIGS. 6 and 7 are fragmentary sectional views taken along the sight lines 6—6 and 7—7 of FIG. 5, respectively.

DETAILED DESCRIPTION

Inasmuch as the instant invention is described in conjunction with the embodiment of U.S. Pat. No. 4,326,348, reference should be made to that patent for any details of construction and operation not expressly set forth herein.

In the illustration given, and with reference first to FIGS. 1 and 2, the numeral 10 designates generally an adapter which, adjacent the rear end 11 thereof, is equipped with a vertical bore 12 for the receipt of a pin lock for attaching the same to excavating equipment.

In the particular illustration given, the forward end of the adapter is provided in the form of nose means 13 and shaped to provide stabilizing surfaces 14 in accordance with the '348 patent.

The numeral 15 designates generally the wear cap which is normally installed first on the adapter 10. The wear cap 15 has a top wall 16 and a pair of integral, depending side walls 17. The wear cap generally extends rearwardly sufficiently to overlap the vertical bore 12. To permit access to the pin lock (not shown) installable in the vertical bore 12, the top wall 16 of the wear cap 15 is equipped with a slot 18 adjacent the rear end of the wear cap.

Interiorily of the side walls 17 are rails 19 which are received within slots or ways 20, 20' provided on the adapter side walls. Thus, the wear cap is able to protect the top wall 21 (see FIG. 5) of the adapter by at least partially covering the same. In some instances, it may be advantageous to protect the bottom wall 22 of the adapter and for that purpose, a second slot 20' is provided to receive the bottom wear cap 15. The point is designated generally by the numeral 23 and is held in place by pin locks generally designated 24.

Wear Cap Lock Means

The wear cap lock means is generally designated 25—see FIGS. 3 and 4 and includes a body 26 and an insert 27 having a resilient portion 28. In the illustration given, the resilient portion 28 is constructed of elastomeric material and is bonded to the steel insert 27. In some instances, these elements may be provided separately with the resilient part 28 being in the form of a spring or the like.

The lock means 25 (now referring to FIGS. 5–7), is removably mounted within a cavity 29 in one of the side walls 30 of the adapter 10.

The cavity 29 as can be best appreciated from a comparison of FIGS. 2 and 6 is defined in part by shoulder-like flanges 31 which serve to confine the lock means 25 when it is installed within the cavity 29.

In the operation of the invention, the insert 27 with the resilient portion 28 is inserted within a recess 32 (see FIG. 4) of the body 26. Thereafter, and referring now to FIG. 6, the nose portion 33 of the body 26 is inserted inwardly of the right hand shoulder 31. Then, by a prying action made possible by means of the pry opening 34 (see FIG. 5), the resilient portion 28 is compressed so as to allow the insert nose part 35 to be forced past the left hand shoulder 31 and into the position depicted in FIG. 6.

This then results in the lock means 25 being installed within the cavity 29 and maintained therein only by its own resiliency and the cooperation of the adapter—no cooperation or restraining force being required by the wear cap or caps 15.

Prior to the installation of the lock means 25 within the cavity 29, one or both wear caps—as desired—have been installed by a sliding longitudinal movement relative to the adapter so that the rails 19 engage the ways 20 or 20'.

It will be noted from a consideration of FIGS. 2 and 5 that the wear caps are equipped with notch means as at 36 to permit the insertion of the lock means 25. The lock means 25 is seen to be symmetrical about a horizontal center line and, in the preferred practice of the invention, the wear caps are identical so that no time or effort need be expended on selecting one wear cap for one location—either will be received on the top or bottom of the adapter. The lock is provided in one or both of the side walls of the adapter. To facilitate this interchangeability of wear caps, two notches 36 are provided as seen in the bottom portion of FIG. 2, one in each of the side walls 17.

In the illustration given, the resilient portion is constructed of elastomeric material which is developed with a plurality of generally cylindrical openings 37 provided therein so as to develop quick and easy compactability.

For removal of the lock means 25, a front pry opening 34 (see the central portion of FIG. 5) is provided for the insertion of a prying means such as a screw driver. This enables the operator to force the nose 35 rearwardly, i.e., to the right in FIG. 5, so as to permit the nose part 35 to pass by the left hand shoulder 31—by again compresssing the resilient portion 28. This easy "snap-in-snap-out" feature is derived from the fact that the lock means 25 is not under stress when lodged within the cavity 29.

The notch 36 in the side wall 17 of either or both of the wear caps 15 conforms generally to the shape of the body 26—as can be appreciated clearly from a consideration of the central portion of FIG. 5.

Thus, when the point 23 is missing—as it is in FIG. 5, and without the lock means 25, there would be nothing to restrain forward movement of the wear caps 15 under a dislodging force—such as gravity. Now, however, there is an interference provided by the body 26, more particularly the wings 39 (see FIG. 3) with the notch-forming walls of the wear cap 15. In fact, as can be best appreciated from a consideration of FIG. 5, the wings 39 are wedge shaped and the walls of the notch 36 are correspondingly tapered so that the force on the lock means 25 is essentially compressive—as contrasted to shear.

Also, the wings 39 (see FIG. 7) are beleved as at 40, 41 from the center line to the sides of the lock. Double bevels are provided because it is not known just which way the lock will be installed, being symmetrical about a horizontal center line. The outer bevel as at 41 relative to the upper wear caps 15 will force the lock against the adapter in case the wear cap moves forward. This will further prevent wear cap locks coming out.

While in the foregoing specification a detailed description of an embodiment of the invention has been set down for the purpose of illustration, many variations in the details hereingiven may be made by those skilled in the art without departing from the spirit and scope of the invention.

We claim:

1. A tooth assembly comprising a relatively elongated adapter having a mounting end and a point receiving end, top and bottom longitudinally extending wear surfaces flanked by side surfaces, a wear cap removably covering one of said wear surfaces, a point on said adapter normally retaining said wear cap in place on said adapter, a cavity in one of said side surfaces and lock means resiliently, removably mounted in said cavity, said wear cap having notch means alignable with said cavity and shaped to cause said wear cap to bear against said lock means upon a dislodging force being applied to said wear cap, said cavity being defined by outer shoulder-providing walls, said lock means including a body and insert means, each of said body and insert means having oppositely directed nose means, said insert means including resilient means operative to enable said nose means to snap into place behind said shoulder providing walls.

2. The tooth assembly of claim 1 in which said shoulder-providing walls are equipped with pry openings.

* * * * *